United States Patent [19]

Baker et al.

[11] 4,440,070

[45] Apr. 3, 1984

[54] MOBILE ADJUSTABLE CURTAIN APPARATUS FOR USE IN ROOM AND PILLAR COAL MINING VENTILATION SYSTEM

[76] Inventors: Paul V. Baker, 839 Chestnut St., Indiana, Pa. 15701; David Vehovic, R.D. 2, Box 144D, Clymer, Pa. 15728

[21] Appl. No.: 337,268

[22] Filed: Jan. 5, 1982

[51] Int. Cl.[3] ..... F24F 7/00

[52] U.S. Cl. ..... 98/50; 299/12

[58] Field of Search ..... 98/50; 160/24, 201; 280/43, 43.14, 43.17, 43.24; 299/12

[56] References Cited

U.S. PATENT DOCUMENTS

| | | | |
|---|---|---|---|
| 245,491 | 8/1881 | Hegeler . | |
| 512,333 | 1/1894 | Simmer . | |
| 1,398,909 | 11/1921 | North | 98/50 |
| 2,425,466 | 8/1947 | Gregory . | |
| 2,693,230 | 11/1954 | Burks . | |
| 2,947,239 | 8/1960 | Burgess . | |
| 2,962,132 | 11/1960 | Reinhardt . | |
| 3,006,267 | 10/1961 | Hargis | 98/50 |
| 3,118,363 | 1/1964 | Burgess, Jr. | 98/50 |
| 3,306,180 | 2/1967 | Asbury | 98/50 |
| 3,712,678 | 1/1973 | Amoroso | 299/68 |
| 3,715,969 | 2/1973 | Burgess, Jr. | 98/50 |
| 3,747,503 | 1/1973 | Lovell | 98/50 |
| 3,813,126 | 5/1974 | Rogne, Jr. et al. | 299/12 X |
| 3,922,016 | 11/1975 | Tyslauk et al. | 280/43.14 X |
| 4,157,204 | 6/1979 | Kissell et al. | 299/64 |
| 4,180,352 | 12/1979 | Divers et al. | 98/50 X |
| 4,230,329 | 10/1980 | Johnson | 280/43.24 X |
| 4,282,802 | 12/1981 | Divers et al. | 98/50 |

FOREIGN PATENT DOCUMENTS

| | | | |
|---|---|---|---|
| 490182 | 2/1930 | Fed. Rep. of Germany | 299/12 |
| 13434 | of 1914 | United Kingdom | 98/50 |
| 772412 | 4/1957 | United Kingdom | 98/50 |

*Primary Examiner*—Albert J. Makay
*Assistant Examiner*—Harold Joyce
*Attorney, Agent, or Firm*—Cushman, Darby & Cushman

[57] ABSTRACT

A section of brattice is mounted on a centrally-wheeled cart. This brattice has a frame that permits the curtain section to be extended and retracted vertically, in order to reduce its height for movement and to adjust its height for engagement of the mine roof. Hydraulic jacks are used for vertical height adjustment. The upper curtain rod rail of the curtain incorporates a spring that is mounted between some spring-mounted posts. When the curtain is raised against the ceiling, the springs allow the top of the curtain to conform to unevenness in the ceiling level. By preference, the wheels are mounted on a yoke so they can be put down for moving the brattice section, and retracted when the brattice section is in place. Two jacks are additionally provided at the ends of the apparatus for extension against the roof when the cart is in place to act as anti-tipping braces for when the brattice section is extended up against the mine roof.

14 Claims, 5 Drawing Figures

MOBILE ADJUSTABLE CURTAIN APPARATUS FOR USE IN ROOM AND PILLAR COAL MINING VENTILATION SYSTEM

BACKGROUND OF THE INVENTION

In mining coal underground in low coal, where the seams, typically, are 2.5–4 feet thick, the room and pillar method of mining often is used. Referring to FIG. 1, which is a fragmentary horizontal sectional view at one level in such a mine, a typical layout is illustrated. A main gallery is illustrated at 10. Shown branching out laterally from the main gallery are a plurality of rooms 12, 14, which are separated by pillars 16. Each pillar 16 is an expanse of coal left unmined in order to retar or prevent subsidence. Although in such a mine, mining may simultaneously be going on in several of the rooms and at several levels, for simplicity a single room 14 is shown having mining going on in it. In brief, a mining machine makes a series of cuts into the face or short wall 18, as a result of which the room 14 gradually becomes longer in the direction of the arrow 20.

It is well-known that as coal is mined, dust and gases may be liberated, especially at the face 18, which gases or dust if merely left to accumulate, could build-up to explosive or unhealthful concentrations. Accordingly, there has long-ago been devised a system for ventilating such rooms while mining is going on, in order to pull so much air across the face that potentially noxious concentrations of escaping gases or dust cannot build-up, because whatever is evolving is whisked-away so quickly. In practicing the conventional ventilating system, the room 14 is nearly divided by a longitudinal line curtain or brattice 22 which extends from the main gallery 10 to a point near the face 18, and from the floor to the roof. Typically, the brattice is made of a fireproofed canvas that is fastened to a batten that is bolted to the roof and/or fastened to posts and it hangs to the floor, where the excess is weighted-down with rocks. Usually, the brattice is not placed on the longitudinal center line of the room, but considerably off toward one side so the room is divided into a wider portion 24 and a narrower portion 26. By means of fans and the like, a pattern of circulation is set up in the direction of the arrows 28. This pattern carries fresh air in from the main gallery 10 through the wider portion 24, sweeps that air across the face 18 and back out through the narrower portion 26. In order to maintain this pattern, the brattice must have its leading edge 30 near the face, but spaced somewhat away from it.

As the room 14 is lengthened in the direction of the arrow 20 through the efforts of the miner operating the mining machine 32 periodically the workers have to stop mining and work on making the curtain extend further, by erecting poles and nailing more curtain material to them, etc.

The problem is that the U.S. government does not want any workers to be right up near the face that is being mined until after the roof has been bolted by a cage-protected roof bolting machine operator (not shown).

So there is somewhat of a conflict in the present regulations: how to extend the curtain, at least temporarily, without any person going into the region where the new section of curtain must be installed.

There are disclosed in the prior art some ways for temporarily extending the line curtain toward the face that is being mined as that face recedes, until another section of regular line curtain can be installed, but none of the prior art ways are entirely satisfactory. In one prior art technique, a support bar is cantilevered horizontally forwards from the top of the foremost support post of the regular line curtain. A section of curtain is hung from this support bar and has its leading edge periodically pushed forwards. Toward the extreme of advancement, the cantilevered support tends to droop, and the lower forward corner portion of the curtain may flap in the currents of ventilating air and tend to close-off the narrow section of the room; or direct the air through the gap between the curtain and the roof and not direct the air across the coal face.

In other prior art attempts at solving the problem, the mining machine itself has been provided with a movable line curtain extension. The result is a compromise: the machine is less maneuverable and the curtain extension is not as effective as one that is mounted independently of the mining machine.

SUMMARY OF THE INVENTION

A section of brattice is mounted on a centrally-wheeled cart. This brattice has a frame that permits one curtain section to be extended and retracted vertically, in order to reduce its height for movement and to adjust its height for engagement of the mine roof. Hydraulic jacks are used for vertical height adjustment. The upper curtain rod rail of the curtain incorporates a spring that is mounted between some spring-mounted posts. When the curtain is raised against the ceiling, the springs allow the top of the curtain to conform to unevenness in the ceiling level.

By preference, the wheels are mounted on a yoke so they can be put down for moving the brattice section, and retracted when the brattice section is in place. Two jacks are additionally provided at the ends of the apparatus for extension against the roof when the cart is in place to act as anti-tipping braces for when the brattice section is extended up against the mine roof.

The location of the apparatus of the invention is suggested in FIG. 1 at 34.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
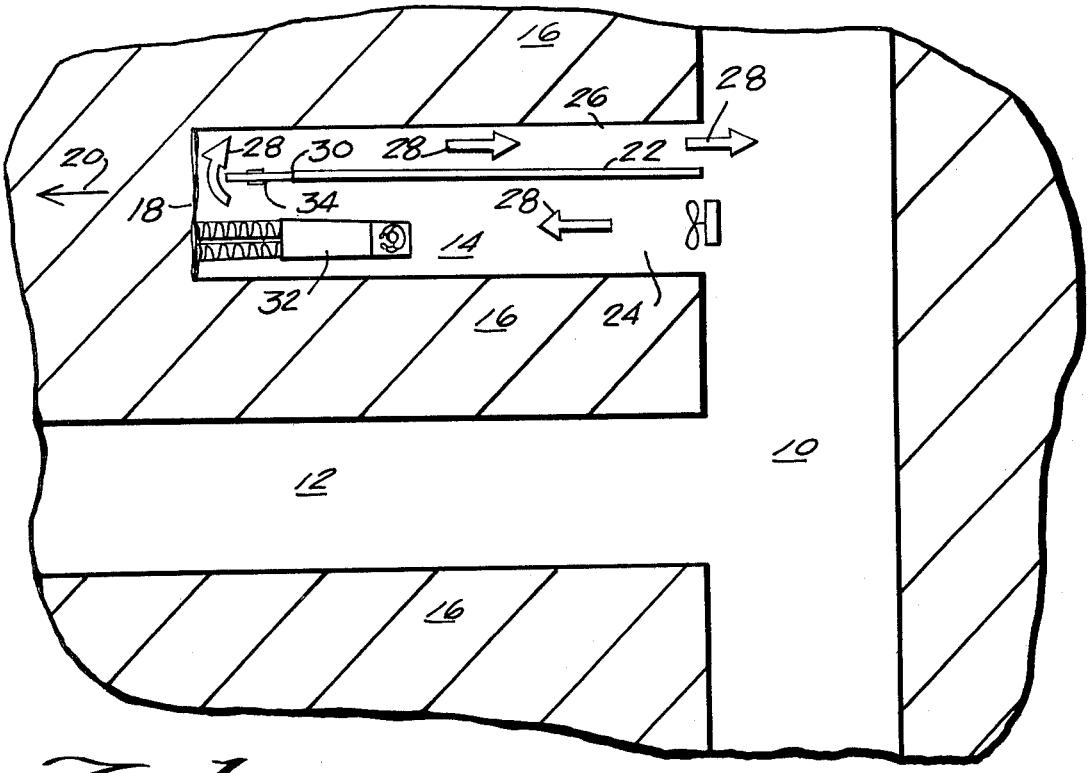
FIG. 1 is a fragmentary horizontal sectional view of a room and pillar-type low seam coal mine, looking down at one level (with the roof broken away)

As set forth above, FIG. 1 shows the environment of intended use of the apparatus 34, as a means for extending the effect of the brattice 22 toward the face 18 as the face recedes in the direction of the arrow 20, until the roof is bolted and the time is right to install another section of regular brattice.

Typically, the device 34 is about fifteen feet long, about a foot wide, about three feet (or less) in height when fully retracted, and potentially about five or six feet in height when in use as a brattice extension. The device 34 is approximately as light and mobile as a modern wheelbarrow or lawn cart, except that it cannot be turned around in so short a space due to its greater length.

As shown, the portable brattice extension apparatus 34 comprises a cart 36 including an elongated base frame 38 and a centrally-located pair of wheels 40. The wheels 40 are mounted to the base frame 38 by a yoke mechanism 42 which, if turned in one sense projects the wheels down so that the cart may be pulled or pushed along e.g. by using the handles 44 provided at the trailing end 46 of the base frame. When the yoke mechanism 42 is turned in the opposite sense, the wheels are retracted upwards so that the base plate 48 of the base frame 38 rests on the floor 50 of the room 14.

At the trailing end 46 and the leading end 52, the base frame 38 is shown provided with a jack post 54 which, preferably, is a hydraulic unit operable from a control box 56 located on the base frame 38 near the trailing end 46. Hydraulically operable jack posts using non-flammable hydraulic fluid are commercially available and certified for use in underground coal mines. The jack posts 54 are based on the base plate 48 or are mounted on the base frame 38 for downward projection through the base plate 48 for engagement with the floor 50. In any event, the upwardly projectable member 58 is arranged to be projected upwards into forced engagement with the mine roof 60 to provide a vertical brace between the floor 50 and the roof 60 at each end of the device 34. This bracing is not of such a kind or character as to make any attempt at holding up the mine roof; its sole purpose is to stabilize the device 34 against tipping over as its curtain is raised.

Accordingly, when the device 34 is to be moved, its jack posts and curtain are fully retracted so that its center of gravity is low. Then the wheels 40 are lowered and the cart 36 is picked-up by the handles 44 and wheeled like a wheelbarrow to its intended new location. There, it is set down and the wheels are retracted, leaving the base plate 48 resting on the floor 50. Next, the jack posts 54 are run up until their pivotally-mounted top plates 62 forcibly engage the roof 60.

Figure 3:
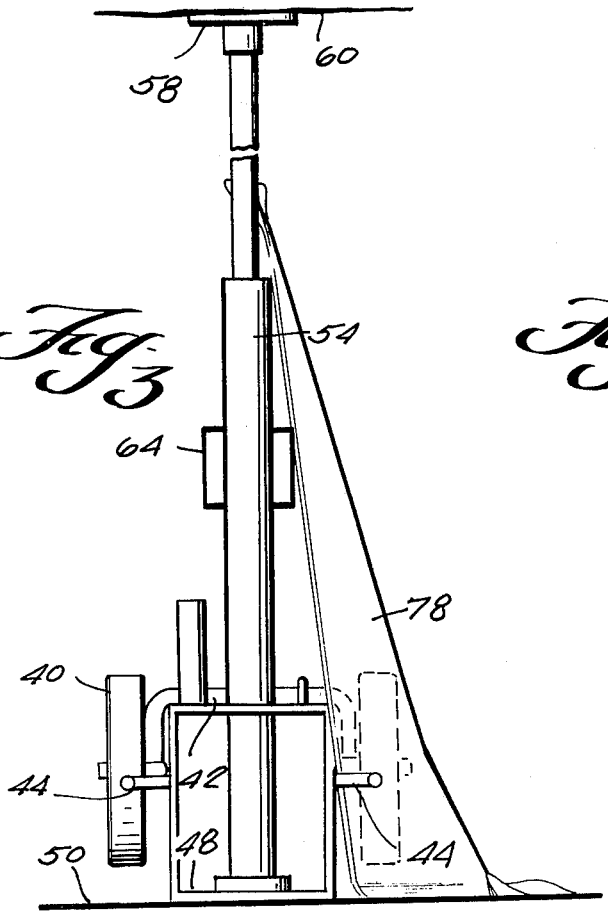
FIG. 3 is an end elevational view of the apparatus at its new position, with the wheels retracted and the end jacks extended.
Figure 5:
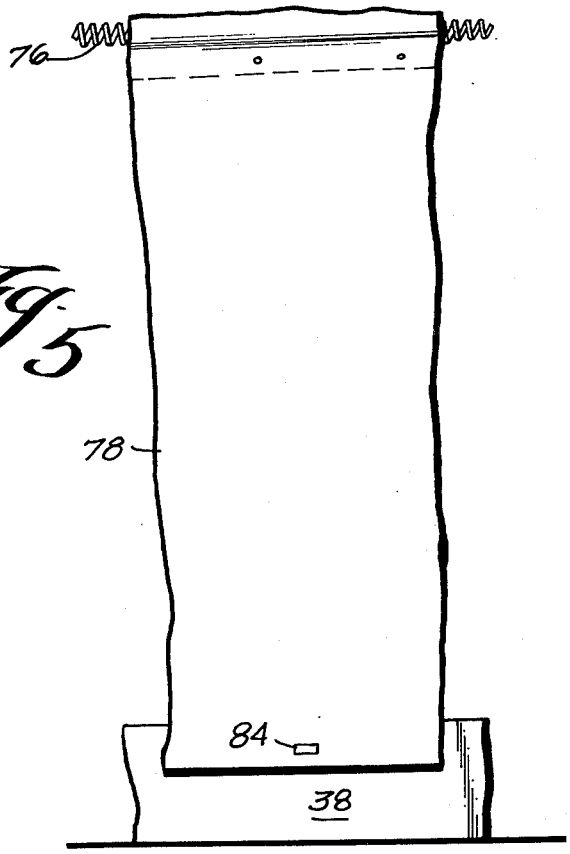
FIG. 5 is a fragmentary front elevational view thereof showing the curtain in more detail.
Figure 2:
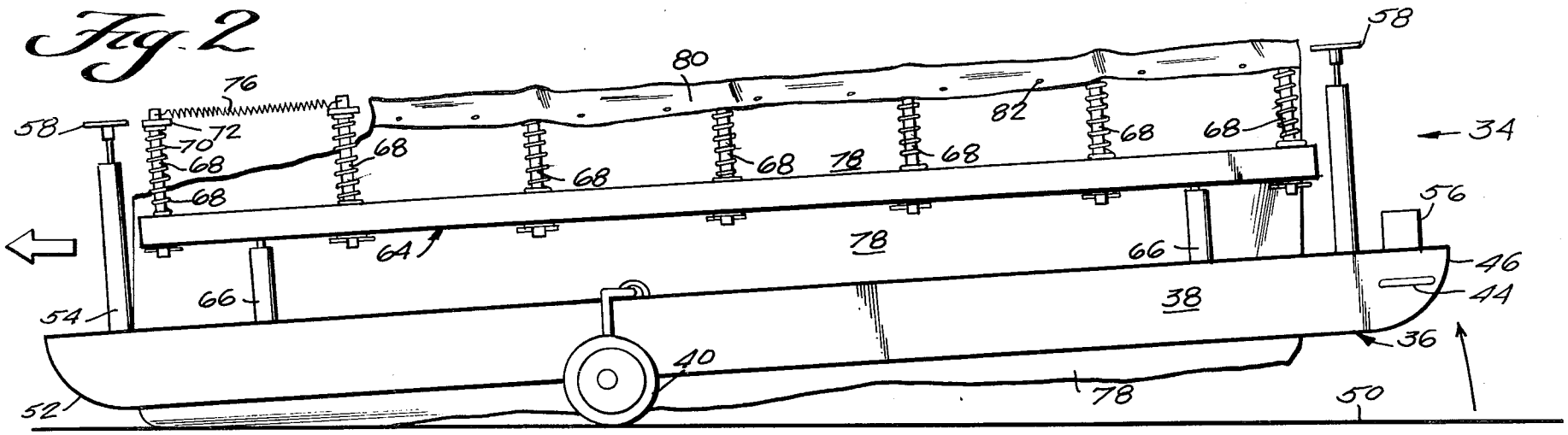
FIG. 2 is a rear elevational view of the apparatus of the invention, shown in a fully retracted condition and being pushed to a new location in the room.
Figure 4:
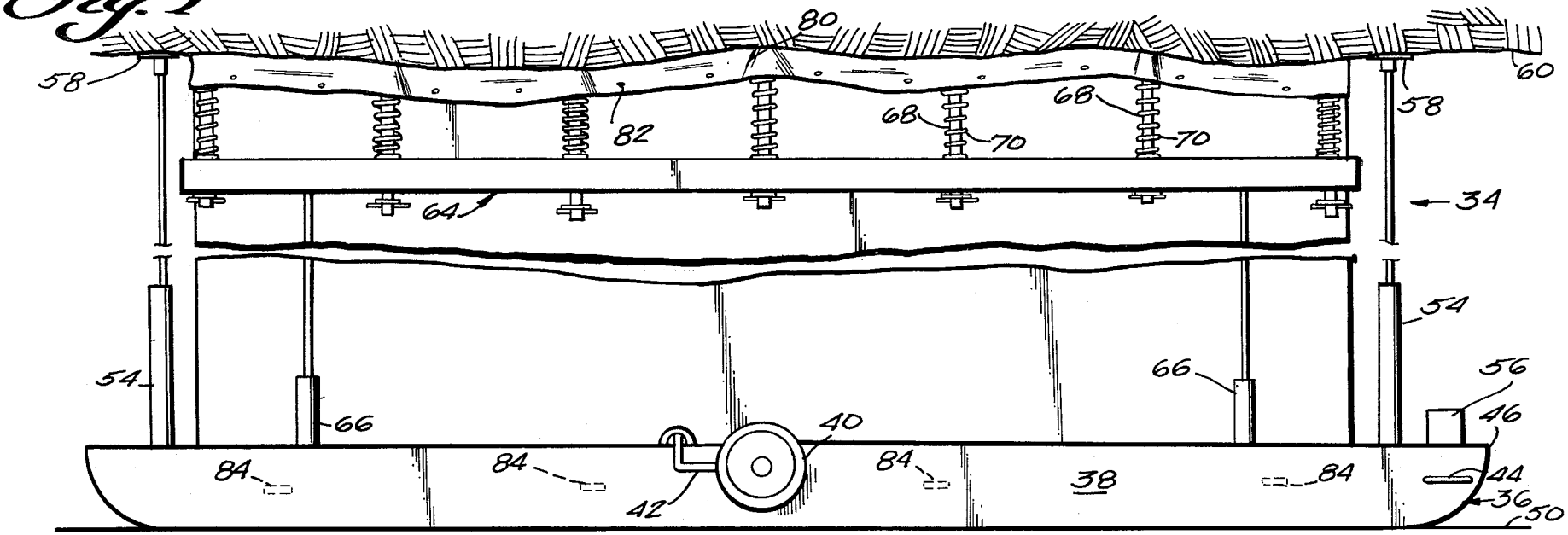
FIG. 4 is a rear elevational view of the apparatus in use as a brattice extender.

The device 34 further includes a curtain frame 64 which includes one or more main longitudinal, horizontal elements. The curtain frame 64 is juxtaposed above the base frame 38 and extends from adjacent the trailing jack post 54 to adjacent the leading jack post 54. The curtain frame 64 is mounted to the base frame 38 by a plurality of (e.g. two) further jack posts 66. These preferably also are commercially available, certified hydraulically operable units operated from the control box 56. When the curtain-raising jack posts 66 are retracted, the curtain frame 64 is disposed as shown in FIGS. 2 and 3; when the curtain-raising jack-posts 66 are extended, the curtain frame 64 is disposed as shown in FIGS. 4 and 5.

A row of spring posts 68 is mounted on the curtain frame 64 to normally project upwards a fixed distance from the longitudinal horizontal frame element 70 thereof on which it is based. Each post 68 is sleeve-mounted in the element 70 and provided with a compression coil spring unit 72 between the element 70 and a collar 74 at its own upper end. Thus, the spring unit 72 normally keeps each post 68 fully projected upwardly, but one may temporarily, partially, resiliently retract a spring post 68 by pushing down on its upper end.

Running horizontally between attachments to the upper ends of each pair of adjacent spring posts 68 is a tension spring 76, e.g. a coil spring or a strip of resilient rubber.

A section of usual, approved brattice material 78 is hung from the curtain frame 64 by having its upper marginal edge portion 80 doubled over the tension springs 76 and spring post upper ends, and secured at 82 by means of any suitable fasteners. The curtain 78 extends generally from the trailing end to the leading end of the device 34.

When the cart 36 has been wheeled to its desired location and the wheels have been retracted, and the stabilizing jack posts 54 have been raised into bracing condition between the floor and roof, the curtain is raised by extending the curtain-raising jack posts 66 until the upper margin of the curtain 78 is jammed against the roof from one end to the other. In the process of doing this, because the roof itself is uneven and possibly even slanted relative to the floor, some of the spring posts 68 will push their part of the curtain upper margin against the roof while at other sites the upper margin of the curtain is still gapped away from the roof. When that happens, the operator continues to raise the curtain frame. Those spring posts which are already indirectly in contact with the roof via their part of the curtain stop rising and begin to become relatively depressed as their springs 72 are progressively compressed. Raising is discontinued when all of the spring posts 68 are in abutment with the roof. Between the spring posts 68, the resilient, tensioned curtain rod springs 76 conform the upper margin of the curtain to the contour of the roof.

The curtain 78 is so vertically long that it comes down to the floor 50, or at least to an overlapping condition with the base frame 38 which in use comes down to the floor. Near its lower margin, the curtain is shown secured by any convenient securement members 84 to the base frame 38 (FIG. 5) so that it will not flap away from the device 34 and obstruct the narrow portion 26 of the room 14.

In a typical cycle of operation, when another section of regular brattice 22 has just been installed so that its leading edge is close enough to the face 18, the apparatus 34 of the invention sits fully retracted and with its wheels down in the narrow portion 26 of the room, beside the regular brattice 22 and with its leading end 52 near the leading edge 30 of the regular brattice 22. After some coal has been cut and carried away using the mining machine 32, the cart 36 is pushed forward from its trailing end until its leading end is where, according to regulations, the leading end of the brattice should be, whereupon the wheels are retracted, the bracing jack posts are extended, and the curtain is raised. The roof bolter (not shown) goes about his or her job conventionally bolting the roof in the newest part of the room. The mining machine is operated to cut and carry away more coal. The curtain is momentarily lowered, the bracing is retracted, the wheels are put down and the cart is advanced further, whereupon the wheels are retracted, the bracing is extended and the curtain is raised. Roof bolting, coal cutting and mobile brattice advancement are carried on in alternation until the trailing edge of the device 34 comes about even with the leading edge of the regular brattice 22. Then, as an added step in the sequence, a further section of regular brattice 22 is conventionally installed.

The wheels 40 preferably are located half way along the device 34 in order to make it easier for one person to lift up the trailing end of the device and move the whole device along. Although the wheel retraction/extension is shown being accomplished by means of a mechanical, manually-operated yoke, this mechanism could also be hydraulically operated from the control box 56, if desirable.

It should now be apparent that the mobile adjustable curtain apparatus for use in room and pillar coal mining ventilation system as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A mobile adjustable curtain apparatus for use in a room-and-pillar coal mining ventilation system, comprising:

a horizontally elongated base having a forward end and a trailing end;

means for rollingly supporting the base on a mine room floor;

a curtain frame means;

means vertically adjustably supporting the curtain frame means upon said base;

a section of brattice curtain having an upper marginal edge secured to said curtain frame means so that when said curtain frame means is adjusted upwardly and downwardly the upper marginal edge of the section of brattice curtain is raised and lowered, the section of brattice curtain having a lower margin extending downwards at least to said base;

a vertically oriented, upwardly extensible/downwardly retractable bracing jack at each end of the base, each bracing jack being adapted to gain purchase between the mine floor and roof to brace the apparatus against tipping over especially when the section of brattice curtain is raised; and handle means operatively connected with said base and being constructed and arranged for manual movement of said apparatus longitudinally along its own length in a room and pillar type of coal mine separately from coal mining machine movement.

2. The apparatus of claim 1, wherein:

the base is constituted by a handcart base having said handle means provided at a rear end of said base;

said means for rollingly supporting the base comprise a pair of laterally spaced wheels located on a transversally extending axis at least approximately midway along the base.

3. The apparatus of claim 2, further comprising:

means for retracting the wheels out of floor-engaging relation.

4. The apparatus of claim 3, wherein:

the wheels are mounted to the base via a yoke which, when turned in one direction retracts the wheels and which, when turned in an opposite direction lowers the wheels into floor-engaging relation.

5. The apparatus of claim 2, wherein:

each bracing jack is constituted by a hydraulically-operated jacking post.

6. The apparatus of claim 5, further including:

a control station for the hydraulically-operated jacking posts, said control station being disposed on said base at the trailing end of said base.

7. The apparatus of claim 1, wherein:

the curtain frame means includes a main horizontally elongated frame element having a row of upstanding spring posts resiliently based thereon in a normally fully upwardly projected condition, but subject to being generally independently pushed relatively downwards by engagement with the mine roof as the curtain frame means is raised.

8. The apparatus of claim 7, further including:

resilient tension members interconnecting each pair of adjacent spring posts;

the upper margin of the section of brattice curtain being secured about said resilient tension members and upon said spring posts for resilient confirmation with local variations in height of the mine roof as the curtain frame means is raised.

9. The apparatus of claim 1 or 7, wherein:

the means for adjustably supporting the curtain frame means upon said base comprises a plurality of hydraulically-operated curtain-raising jacks interconnecting the curtain frame means and the base.

10. The apparatus of claim 9, further including:

each bracing jack being constituted by a hydraulically-operated jacking post;

a common control station for the hydraulically-operated jacking posts and the hydraulically-operated curtain-raising jacks, said common control station being disposed on said base at the trailing end of said base.

11. The apparatus of claim 1, wherein:

the section of brattice curtain has means securing lower margin thereof to said base.

12. A method for providing a temporary forward extension of a regular brattice in a room and pillar coal mining ventilation system, comprising:

(a) manually rolling forward of the leading edge of the regular brattice, towards the face which is being mined, a handcart having a section of brattice curtain longitudinally, vertically extending height-adjustably mounted thereon, until the cart is partially exposed;

(b) immobilizing the cart;

(c) bracing the cart against tipping over sideways, by erecting jacking posts between the cart and the mine roof; and (d) raising the section of brattice curtain vertically into engagement with the mine roof, while said section of brattice curtain hangs to adjacency with the floor of the mine.

13. The method of claim 12, wherein:

the cart is a wheeled base, and the cart is immobilized by raising the wheels relative to the base until the base rests on the floor of the mine.

14. The method of claim 12, further comprising:

after retracting the mine face by cutting and carrying away some coal, (e) lowering the section of brattice curtain temporarily;

(f) retracting the bracing jacking posts;

(g) making the cart mobile again; and (h) repeating steps (a), (b), (c) and (d).

* * * * *